US009007270B2

(12) United States Patent
Ngo Bui Hung

(10) Patent No.: US 9,007,270 B2
(45) Date of Patent: Apr. 14, 2015

(54) VHF/UHF BROADBAND DUAL CHANNEL ANTENNA

(75) Inventor: Frédéric Ngo Bui Hung, Franconville (FR)

(73) Assignee: Thales, Courbevoie (FR)

( * ) Notice: Subject to any disclaimer, the term of this patent is extended or adjusted under 35 U.S.C. 154(b) by 775 days.

(21) Appl. No.: 13/256,181

(22) PCT Filed: Feb. 23, 2010

(86) PCT No.: PCT/EP2010/052302

§ 371 (c)(1), (2), (4) Date: Dec. 19, 2011

(87) PCT Pub. No.: WO2010/102901

PCT Pub. Date: Sep. 16, 2010

(65) Prior Publication Data

US 2012/0119964 A1 May 17, 2012

(30) Foreign Application Priority Data

Mar. 13, 2009 (FR) ..... 09 01187

(51) Int. Cl.

| | |
|---|---|
| ***H01Q 9/04*** | (2006.01) |
| ***H01Q 1/00*** | (2006.01) |
| ***H01Q 9/30*** | (2006.01) |
| ***H01Q 5/00*** | (2006.01) |

(52) U.S. Cl.

CPC . *H01Q 9/30* (2013.01); *H01Q 5/00* (2013.01); *H01Q 5/0041* (2013.01); *H01Q 5/0048* (2013.01)

(58) Field of Classification Search

CPC ..... H01Q 5/00; H01Q 5/0034; H01Q 5/0041; H01Q 5/0048; H01Q 5/0051; H01Q 5/0058; H01Q 5/0072; H01Q 1/242; H01Q 1/243; H01Q 9/30; H01Q 9/32

See application file for complete search history.

(56) References Cited

U.S. PATENT DOCUMENTS

| | | | | |
|---|---|---|---|---|
| 5,307,078 | A * | 4/1994 | Tanaka et al. | 343/791 |
| 5,311,201 | A | 5/1994 | Lillie et al. | |
| 5,977,920 | A * | 11/1999 | Hung | 343/715 |

FOREIGN PATENT DOCUMENTS

| | | | |
|---|---|---|---|
| EP | 0851532 | A1 | 7/1998 |
| FR | 2689688 | A1 | 10/1993 |
| WO | 97/12417 | A1 | 4/1997 |
| WO | 97/41621 | A1 | 11/1997 |

* cited by examiner

*Primary Examiner* — Hoang V Nguyen
*Assistant Examiner* — Patrick Holecek
(74) *Attorney, Agent, or Firm* — Baker & Hostetler LLP

(57) ABSTRACT

A compact dual-channel antenna operating at least in two frequency bands, comprises at least the following elements: a coaxial cable connected to a reference ground, an antenna element designed to operate in the high-frequency band, having a length $L_{inf}$, a counter-skirt with a length roughly corresponding to $L_{inf}$ and arranged around said antenna element, said duly surrounded antenna element being placed between the ground plane and an antenna element designed to operate in the low-frequency band, the assembly having a length $L_{sup}$ designed to operate in the low-frequency band and consisting of the antenna element and the counter-skirt, fed via the core of said coaxial surrounding a magnetic element to form a winding, said antenna element being fed via a braid of the sheath of said coaxial.

10 Claims, 3 Drawing Sheets

VHF/UHF BROADBAND DUAL CHANNEL ANTENNA

CROSS-REFERENCE TO RELATED APPLICATIONS

This application is a National Stage of International patent application PCT/EP2010/052302, filed on Feb. 23, 2010, which claims priority to foreign French patent application No. FR 0901187, filed on Mar. 13, 2009, the disclosures of which are incorporated by reference in their entirety.

BACKGROUND

The object of the invention relates to wideband dual-channel antennas for applications in which the bulk parameter is predominant. It targets in particular the antennas whose working frequencies are situated in the metric and decimetric wavebands, commonly called VHF (Very High Frequency) and UHF (Ultra High Frequency). The values for these frequency bands are, for example, for the VHF band, designated low band: 30-88 MHz, and, for the UHF band, designated high band: 225-520 MHz.

The expression "dual-channel antenna" should be understood to mean an antenna made from at least two radiant elements which are fed separately by means of two channels. These radiant elements may be activated simultaneously in certain cases in both frequency bands or else alternately.

It is known practice to produce a double antenna with a unipolar-type radiant element designed for the low frequencies, topped by a dipole-type radiant element designed for the high frequencies and fed through the unipolar-type radiant element. Most of the antennas of this type operate in a frequency band which is insufficient for certain applications.

The patent EP 0 851 532 (FIG. 1) describes a double antenna according to the prior art, in particular for vehicles, characterized in that it comprises a ground plane pierced by an orifice, with, on one side of the ground plane, the space outside the vehicle and, on the other side, a protected space; a coaxial cable 2 passes through the orifice, with a first end in the space outside the vehicle and a second end in the protected space, the cable forming turns 22 between the orifice and its second end; a link between the outer conductor of the cable and the ground plane at the second end; a radiant element of dipole type 1 connected to be fed, to the first end of the cable; a transformer consisting of a magnetic core 5 and the turns 22 whose secondary comprises the outer conductor of the turns, an impedance 6 with a value equal to the characteristic impedance of the cable, two feed cables 8*a*, 8*b*. The core of the cable 8*a* is connected to the point P situated on the outer braid of the portion of coaxial cable forming the turns 22 and intended to convey the RF signals of the VHF band or low band for the application. The coaxial 8*b*, however, has its core linked to that of the coaxial cable 2 through the duplexer 9 and conveys the RF signals of the UHF band designated as high band. The low band is fed via the braid of the coaxial cable 2. The antenna elements consist of monopole and dipole.

One of the drawbacks with such an antenna is that it is not suited, because of its size, to portable-type applications, for which the bulk/efficiency pairing is a crucial factor.

The patent U.S. 5,311,201 describes an antenna capable of operating in the AM/FM radio broadcast bands and also in the higher frequency band reserved for mobile radio. This antenna with two ports for vehicles intended for the reception only of the AM/FM broadcast radio and the transmission/reception of the UHF radiotelephone band (GSM) has the drawback of providing only reception on one of the channels.

SUMMARY OF THE INVENTION

One of the objectives of the invention is to provide an antenna that is designed to be used for dual-channel portable radiocommunication applications and to have a compact antenna structure, while offering a high efficiency and an isolation between channels that is sufficient in a wide frequency band, at least one octave, for simultaneous operation invariably on both channels in transmission mode and/or in reception mode.

The object of the invention relates to a compact dual-channel antenna operating at least in two frequency bands, a high band [$F_{sup1}$, $F_{sup2}$] and a low band [$F_{inf1}$, $F_{inf2}$], characterized in that it comprises at least the following elements:

- a coaxial cable connected to a reference ground (M) comprising a core and a braid,
- an antenna element designed to operate in the high-frequency band [$F_{sup1}$, $F_{sup2}$], having a length $L_{inf}$,
- a counter-skirt with a length roughly corresponding to $L_{inf}$ and arranged around said antenna element, said duly surrounded antenna element being placed between the reference ground plane (M) and an antenna element designed to operate in the low-frequency band [$F_{inf1}$, $F_{inf2}$],
- the assembly consisting of the antenna element and the counter-skirt, having a length $L_{sup}$, is fed via the core of said coaxial, said assembly being designed to operate in the low-frequency band [$F_{inf1}$, $F_{inf2}$],
- said antenna element being fed via the outside of the braid of said coaxial, at a tapping point, P,
- two wideband matching cells, and in that

- the coaxial cable is wound around a magnetic element to form a winding,
- the signals of the UHF high band are transmitted via the braid of the coaxial forming the winding through the matching cell and the tapping point or tap P,
- the VHF low channel is fed via the inside of the winding via the core of the coaxial cable through the matching cell.

The so-called high-frequency frequency band is, for example, the UHF band [225-520 MHz] and the so-called low-frequency band is the VHF band [30-88 MHz].

The length $L_{inf}$ may be roughly equal to a quarter of the wavelength of the geometric mean frequency $F_{MOY}$ of the high band.

The antenna element designed to operate in the low band consists of a single-wire element arranged in the extension of the core of the coaxial and of the counter-skirt.

The coaxial cable passes through the reference ground plane M and is extended above the reference ground plane M by a height $L_{UHF}$ equal to a quarter of the wavelength of the geometric mean frequency $F_{MOY}$ of the high band [$F_{sup1}$, $F_{sup2}$]. The feed for the low band is offset to produce a system more commonly referred to as "center-fed".

The radiant elements forming the antenna are, for example, monopole-type elements.

The coaxial cable being wound around a magnetic element to form a winding, it also comprises a low-pass element (38) designed to connect the point of the braid of the coaxial cable forming the end of said winding to the ground M.

The core of the coaxial cable is, for example, linked to the single-wire strand through a wideband matching cell. The low band signals are conveyed by the core of the coaxial.

The antenna structure according to the invention is a compact structure intended notably for portable type applications. The overall size of the antenna structure is reduced to the maximum while retaining a high efficiency and an adequate isolation between channels.

In order to reduce the size of the antenna to the maximum, the invention makes it possible notably to implement only monopole-type radiant elements, for the high band and the low band, unlike in the patents EP 0 851 532 and U.S. Pat. No. 5,311,201 which, for the high band, use a dipole-type structure. Another advantage of the invention is avoiding the unbalance effect caused by the position at the top of the antenna of the dipole element intended for the high band described in the abovementioned patents.

BRIEF DESCRIPTION OF THE DRAWINGS

Other features and advantages of the device according to the invention will become more apparent from reading the following description of an exemplary embodiment given as an illustrative and nonlimiting example, with appended figures which represent.

DETAILED DESCRIPTION

The idea of the present invention to form a compact-size antenna relies notably on the implementation of a monopole-type radiant element and on the excitation thereof, over its entire length for the low band (VHF) corresponding to the frequency range [$F_{inf1}$, $F_{inf2}$] and only over a portion of its length for the high band (UHF) corresponding to the frequency range [$F_{sup1}$, $F_{sup2}$], in which frequency bands the compact antenna is intended to operate.

The description relates equally to antennas that can operate in transmission mode simultaneously on both UHF and VHF channels, or else in transmission mode on the UHF channel and in reception mode on the VHF channel, and vice versa, or else on both channels in reception mode simultaneously or else in transmission mode simultaneously.

Figure 1:
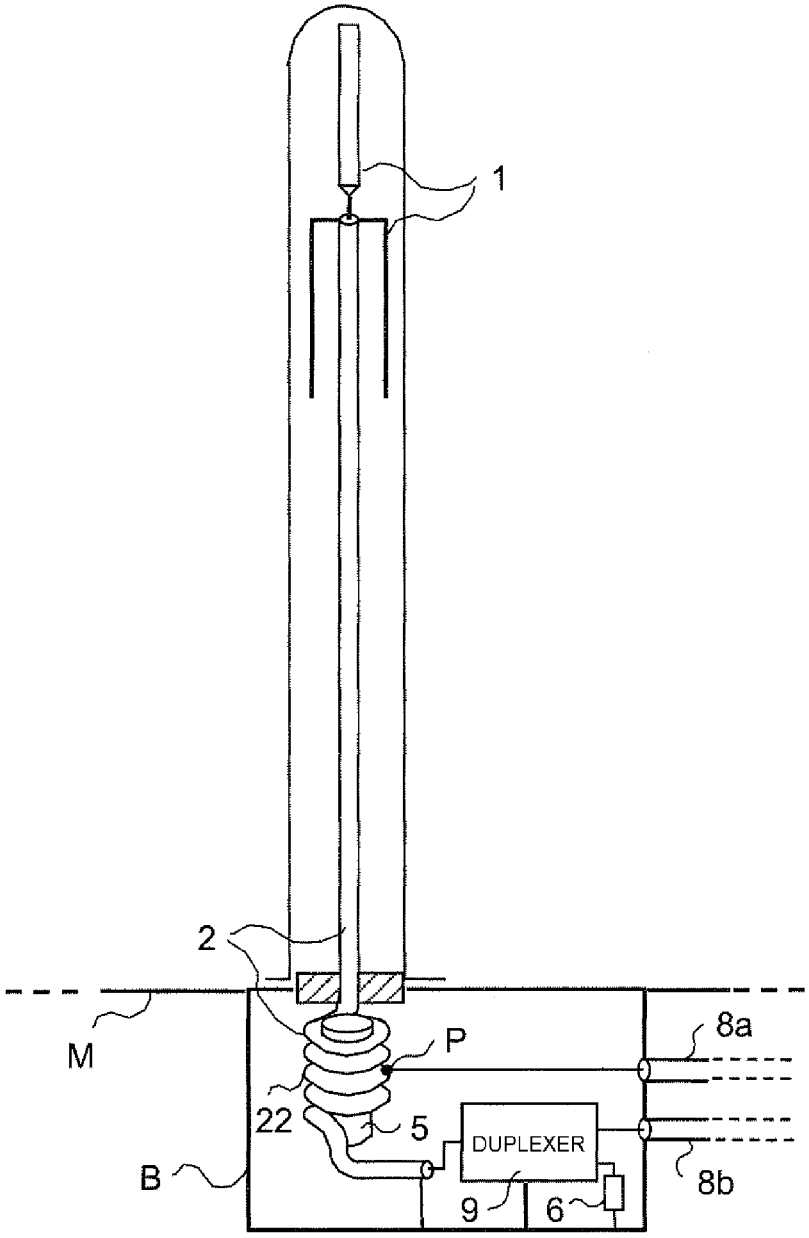
Fig. 1 Prior art
FIG. 1, the diagram of a dual-channel antenna according to the prior art.
Figure 2B:
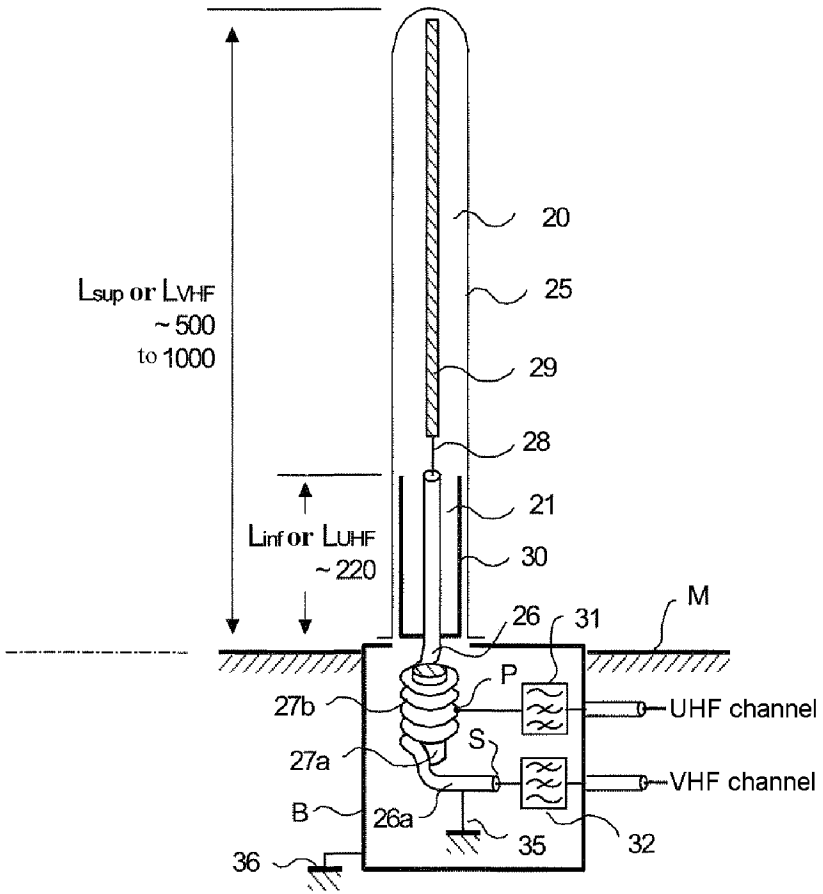
FIG. 2A, an exemplary structure for the antenna according to the invention and FIG. 2B, a simplified block diagram of the antenna with its link with a connector, and FIG. 3, a variant of the invention.
Figure 2A:
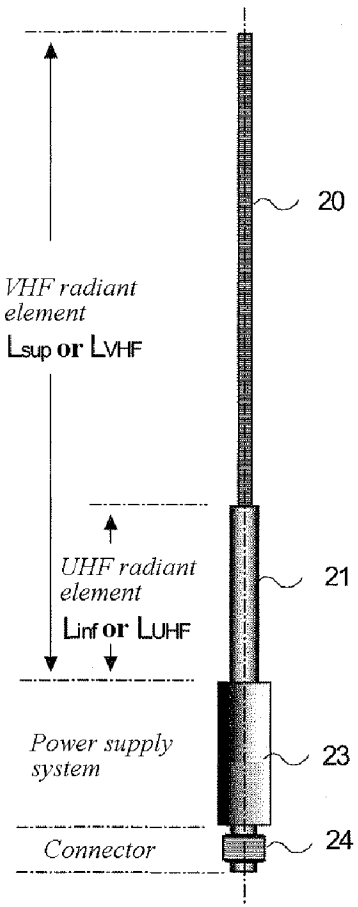

FIGS. 2A and 2B represent an antenna intended to operate in the VHF frequency band: 30-88 MHz and the UHF frequency band: 225-520 MHz.

FIG. 2A is a simplified description of an exemplary antenna structure according to the invention comprising a VHF radiant element 20, having a length $L_{VHF}$, or $L_{sup}$ because of its position, roughly equal to the overall length of the antenna, a UHF radiant element 21, arranged in the bottom portion of the antenna, having its own length $L_{inf}$ because of its position in the bottom portion of the antenna or $L_{UHF}$, a feed system 23 linked to a connector 24 designed to feed both UHF and VHF channels independently.

FIG. 2B is a detailed representation of an exemplary antenna having an antenna structure similar to the structure of FIG. 2A. A radome 25, preferably made of a flexible material, is arranged around the antenna elements 20 and 21 in order to protect them. A coaxial cable 26 consisting of a core 28 surrounded by a braid 26*a* or sheath is wound around a magnetic core 27*a* to form the winding 27*b* of a transformer, and the assembly is arranged in a miniaturized housing referenced B. The coaxial cable 26 passes through a reference ground plane M and is extended above the reference ground plane M over a height $L_{UHF}$ equal to approximately a quarter of the wavelength of the geometric mean frequency $F_{MOY}$ of the high band, that is to say, $F_{MOY}$=340 MHz and $L_{UHF}$=220 mm in the frequency range given for this example. The core 28 of the coaxial cable 26 is extended above the height $L_{UHF}$ by a single-wire element 29 with a length $L_{fil}$. The choice of the material and the length $L_{fil}$ are determined, for example, by the operational requirements. It is thus possible to use, for the example given, a length varying from 280 mm to 750 mm for $L_{fil}$. A tap P is produced on the winding 27*b* to form the input for the high band and the second output S of the core of the coaxial that of the low band. The coaxial cable is connected to ground at the point S.

In order to isolate the radiant currents of the 2 channels, a counter-skirt 30 is added to the coaxial cable 26 and forms the radiant element 21 in the high band.

The VHF-fed part corresponds roughly to the entire height of the antenna, that is to say the element 29 plus the portion of the coaxial corresponding to the height $L_{UHF}$ of the antenna element 21 plus the counter-skirt 30. Such a radiant structure with the feed point offset from the reference ground plane is commonly referred to by those skilled in the art as a "sleeve monopole".

For the low band, this counter-skirt 30 behaves as a load inductance connected in series with the single-wire strand 29 to form an inductively-loaded sleeve monopole, the assembly 29 and 30 forming the radiant element in the low band. This counter-skirt 30 may be complemented with other devices known to those skilled in the art and not represented to simplify the understanding of the antenna according to the invention, in order to increase the isolation. In order to provide the impedance matching for the 2 channels, wideband matching cells 31, 32 known to those skilled in the art are inserted between the ports and the connectors of the antenna.

The length $L_{sup}$ or $L_{VHF}$ is, for example, within the range [500, 1000] mm. The length $L_{UHF}$ corresponding to the coaxial cable extending above the reference ground element M is, for example, equal to 220 mm. The choice of the lengths $L_{VHF}$, $L_{UHF}$ is defined in relation to the desired compactness of the antenna. Preferably, the choice of the lengths is made by first determining the length $L_{UHF}$ according to the frequencies desired for the operation of the antenna and the targeted bulk, that is to say relative to a total antenna length to be observed $L_{total}$. The length $L_{VHF}$ for the antenna element for the low frequencies will be determined by the remaining space available considering the two lengths $L_{UHF}$ and $L_{total}$.

The power feed for the antenna elements is provided as follows:

- To feed RF power to the antenna for the UHF channel, the high band signals are transmitted via the braid of the sheath of the coaxial cable 26 forming the winding 27*b* through the matching cell 31 and a tapping point or tap P.
- The VHF channel is fed via the inside of the winding 27*b*, via the core 28 of the coaxial cable 26 through the matching cell 32.

The winding 27*b* and the feed circuit are connected to ground at the points 35 and 36.

The radome 25 is, for example, made of a dielectric material that is transparent to the electromagnetic waves. It holds the radiant elements in the vertical position and secures them to the feed circuit. It also offers a certain flexibility so as not to injure the user in an operational configuration.

The feed circuit 23 is arranged in a miniaturized housing B making the antenna assembly sufficiently compact to be associated with an intercom-type portable radio appliance.

There are various possible ways of using the antenna. Thus, the two antenna elements may both operate in transmission mode, simultaneously. It is also possible for one of the two elements to operate in transmission mode, while the other operates in reception mode. Both can also operate in reception mode.

Figure 3:
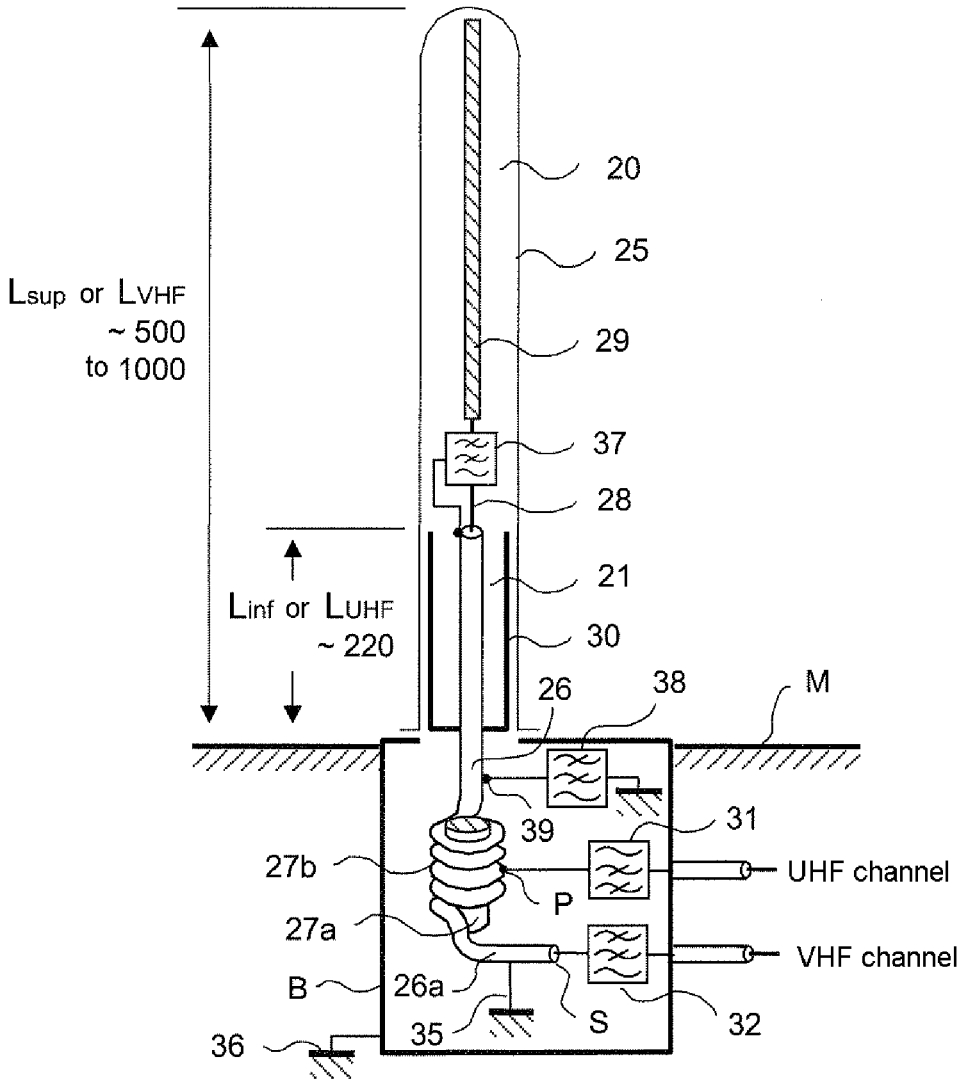

FIG. 3 represents a variant embodiment of the invention. It consists in linking the core 28 to the single-wire strand 29 through a wideband matching cell 37 whose possible different structures are known to those skilled in the art and which is not detailed here. The function of this matching cell is notably to improve the efficiency of the antenna. Another variant is to connect the foot of the antenna to the ground for the low band signals. It consists in connecting, at the end of the winding 27*b*, the point 39 of the braid of the coaxial cable 26 to the ground via a low-pass element 38 which is not detailed here. This variant makes it possible to improve the isolation between the two channels.

The invention claimed is:

1. A compact dual-channel antenna operating at least in two frequency bands, a high-frequency band [$F_{sup1}$, $F_{sup2}$] and a low-frequency band [$F_{inf1}$, $F_{inf2}$], comprising:

a coaxial cable connected to a reference ground plane (M) comprising a core and a braid, the coaxial cable is wound around a magnetic element to form a winding, a first antenna element designed to operate in the high-frequency band [$F_{sup1}$, $F_{sup2}$], having a length $L_{inf}$, said length $L_{inf}$ being equal to a quarter of a wavelength of a geometric mean frequency of the high-frequency band, a counter-skirt with a length substantially equal to $L_{inf}$ and arranged around said first antenna element and being in direct electrical connection with the coaxial cable, said surrounded first antenna element being placed between the reference ground plane and a second antenna element designed to operate in the low-frequency band [$F_{inf1}$, $F_{inf2}$], an assembly including the second antenna element and the counter-skirt, having a length $L_{sup}$, is fed via the core of said coaxial cable, said assembly being designed to operate in the low-frequency band [$F_{inf1}$, $F_{inf2}$], said first antenna element being fed via the outside of the braid of said coaxial cable, at a tapping point, P, and a first wideband matching cell and a second wideband matching cell, wherein signals of the high-frequency band are transmitted via the braid of the coaxial cable forming a coil through the first wideband matching cell and the tapping point P, and wherein signals of the low-frequency band are fed via an inside of the coil through the core of the coaxial cable through the second wideband matching cell.

2. The compact dual-channel antenna as claimed in claim 1, wherein the high-frequency band is a UHF band [225-520 MHz] and the low-frequency band is the VHF band [30-88 MHz].

3. The compact dual-channel antenna as claimed in claim 1, wherein the second antenna element adapted to operate in the low-frequency band includes a single-wire element arranged in an extension of the core of the coaxial cable and of the counter-skirt.

4. The compact dual-channel antenna as claimed in claim 1, wherein the coaxial cable passes through the reference ground plane M and is extended above the reference ground plane M by a height $L_{UHF}$ equal to a quarter of the wavelength of the geometric mean frequency $F_{MOY}$ of the high-frequency band [$F_{sup1}$, $F_{sup2}$].

5. The compact dual-channel antenna as claimed in claim 1, wherein the first antenna element and the second antenna element form radiant elements forming the compact dual-channel antenna, said radiant elements being monopole-type elements.

6. The compact dual-channel antenna as claimed in claim 1, further comprising a low-pass element designed to connect a point of the braid of the coaxial cable forming an end of said winding to the reference ground plane M.

7. The compact dual-channel antenna as claimed in claim 3, wherein the coaxial cable passes through the reference ground plane M and is extended above the reference ground plane M by a height $L_{UHF}$ equal to the quarter of the wavelength of the geometric mean frequency $F_{MOY}$ of the high-frequency band [$F_{sup1}$, $F_{sup2}$].

8. The compact dual-channel antenna as claimed in claim 7, wherein said core of the coaxial cable is linked to a single-wire strand through a third wideband matching cell.

9. The compact dual-channel antenna as claimed in claim 3, wherein said core of the coaxial cable is linked to a single-wire strand through a third wideband matching cell.

10. The compact dual-channel antenna as claimed in claim 4, wherein said core of the coaxial cable is linked to a single-wire strand through a third wideband matching cell.

* * * * *